United States Patent [19]

Colwell

[11] 4,102,053

[45] Jul. 25, 1978

[54] REMOVABLE RIFLE SIGHT

[76] Inventor: Stephen Earl Colwell, Westminster, Calif. 92676

[21] Appl. No.: 814,170

[22] Filed: Jul. 11, 1977

[51] Int. Cl.[2] ..... F41G 1/08

[52] U.S. Cl. ..... 33/233; 33/243; 33/250; 335/285

[58] Field of Search ..... 33/233, 250, 242, 243, 33/263, DIG. 1; 335/285; 248/206 A

[56] References Cited

U.S. PATENT DOCUMENTS

| | | | |
|---|---|---|---|
| 1,540,772 | 6/1925 | Gibbs | 33/233 |
| 1,778,481 | 10/1930 | Boucher | 335/285 X |
| 2,633,051 | 3/1953 | Davis | 33/233 X |
| 2,861,344 | 11/1958 | Moore | 33/233 |
| 2,931,101 | 4/1960 | Martin | 335/285 X |
| 3,319,989 | 5/1967 | Ross | 335/285 X |
| 3,503,024 | 3/1970 | Iwaki | 335/285 |

*Primary Examiner*—William D. Martin, Jr.
*Attorney, Agent, or Firm*—William C. Babcock

[57] ABSTRACT

A fast sighting device adapted for convenient substitution in place of a conventional rear rifle sight comprising a rectangular support including a ceramic magnet supported on an eccentric cam on the interior thereof. A support further includes a front and rear locating pin, the front pin being disposed for longitudinal translation within an elongate opening, said front and rear pins being dimensioned to accommodate the conventional mounting holes for the substituted sight. Extending from the rear end of the support is a circular, vertically aligned, sight orifice, threaded on the interior over the rear segment thereof for receiving a retainer cap compressing a sight disc or other sighting device therebetween. It is intended to form the support and the sight aperture from a nonmagnetic material such as plastic, the disposition of the ceramic magnetic therein being adjustable by the eccentric cam to achieve either a contiguous alignment with the rifle barrel or a separated alignment for removal.

6 Claims, 4 Drawing Figures

REMOVABLE RIFLE SIGHT

BACKGROUND OF THE INVENTION

1. Field of the Invention

The present invention relates to fire arm sighting devices, and more particularly to removable sights adapted for quick interchange.

2. Description of the Prior Art

In many competitive events involving fire arms there is often the requirement of varying the sighting aspects thereof. Typically an event may comprise various aiming positions and often a fast sighting task is combined therewith. Heretofore most target fire arms were provided with either open or peep hole sights at the rear which are primarily adapted for accurate and deliberate sighting and are less than optimal in fast sighting applications. Shooting towards a moving object, in particular, requires a substantially different sighting system then that entailed in still target use. The participant therefore will have to carry a complement of fire arms each specifically directed to a particular sighting application, and each furthermore requiring the accuracy of shot and therefore the high tolerances of a precision fire arm. Heretofore any flexibility of use of such high precision fire arms has been achieved by way of various sights. which because of their mounting complexity entail elaborate attachment sequences, most of the effort being expended in the design of the sighting aperture itself rather than in the attachment. Quick removal feature were mostly incorporated in telescopic sight mount and even in those instances close machining tolerances were required in the mating surfaces between the mount and the fire arm and elaborate provisions were included in the attachment thereof.

SUMMARY OF THE INVENTION

Accordingly, it is the general purpose and object of the present invention to provide a conveniently interchangeable sighting device for a firearm which in its structural detail includes provisions adapted to accommodate various sight fastening patterns.

Further objects of the invention are to provide a rear sight substitute adapted for use in fast sighting applications.

Yet additional objects of the invention are to provide a rear sight assembly magnetically secured to the barrel of a fire arm.

Yet further objects of the invention are to provide a fast sighting substitute for the conventional open sight of a firearm which is easily mounted and removed.

Yet additional objects of the invention are to provide a replaceable sighting fixture which is conveniently used, requires few parts and is therefore simple in manufacture.

Briefly these and other objects are accomplished within the present invention by providing a hollow rectangularly shaped support fixture including a rectangular cavity on the interior thereof. Received within the rectangular cavity is a ceramic magnet similarly rectangular in dimension, the size of the ceramic magnetic being smaller than the transverse dimensions of the cavity. An eccentric lever-actuated cam extends through the fixture, passing the cam surface thereof through a lateral opening in the ceramic magnet. By virtue of this cam-lever combination, the ceramic magnet may be articulated within the cavity between a withdrawn position and an extended position where the exterior surface of the magnet is aligned in a common plane with the supporting surface of the fixture.

It is intended to convolve the exterior surface of the fixture and similarly the exposed surface of the ceramic magnet along a convolution conformed to the exterior of a firearm barrel. To this end it is to be noted that most firearms of same caliber assume substantially equal exterior surface form and the fixture including the ceramic magnet is therefore universally adaptable to a wide range of applications. To provide for an accurate longitudinal alignment of the fixture on the exterior of the barrel it is further intended to include a front and rear locating pin extending downwardly along the front and rear edges of the ceramic magnet, the forward locating pin being mounted in a longitudinal slide for fore and aft translation. It is these pins that are aligned for receipt within the fastener bores normally found on the rifle barrel, the bores being provided thereat for securing the conventional open rear sights. It is therefore intended to utilize the fixture summarized above in substitution for the open sight normally found on the firearm, the ceramic magnet and the locating pin providing the necessary fixation of the fixture thereon.

Formed on the rear end of the fixture and extending distally away from the joining surface thereof, is a circular aperture provided with an inwardly threaded segment over one section thereof. Received within the aperture is a sighting disc or similar sighting device which is secured thereat by an externally threaded ring dimensioned for receipt within the aperture.

It is furthermore contemplated to utilize non-magnetic materials for the structure of the support fixture and the sighting aperture, plastic material like nylon reenforced with glass being found particularly useful for the purposes herein. In this manner, a sighting device, relatively inexpensive in manufacture, can be provided extending the use of a firearm in competition, and furthermore extending the use of a precision firearm to hunting applications or similar uses where sighting towards a moving target is contemplated.

DESCRIPTION OF THE SPECIFIC EMBODIMENT

While the following description illustrates, with specificity, the use of the inventive sighting' device as a rear sight of a rifle, such is exemplary only. It is to be understood that uses other than those expressly illustrated can be achieved by the features disclosed herein and no intent to limit the scope of the invention is expressed by the illustrations chosen.

Figure 1:
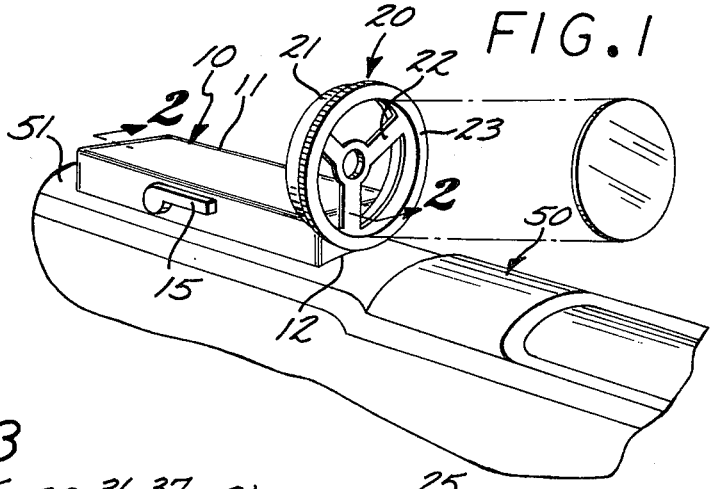
FIG. 1 is a perspective illustration of an inventive sliding device shown installed in the rear sight position on a conventional firearm.

As shown in FIG. 1 the sighting device 10 is disposed at the rear sight location proximate the receiver of a conventional firearm 50. Included in the device 10 is a support fixture 11 substantially rectangular along all surfaces and conformed on the mating surface 12 thereof to the exterior convolutions of the barrel 51 of firearm 50. Extending from one lateral surface of the fixture 11 is a manually articulated lever 15 adapted to provide the securing and releasing actuation. Included further on the exterior of fixture 11, at the rear end thereof is a circular sight aperture 20 comprising a ring 21 attached to the fixture 11 supporting a sight disc 22 secured on the interior of the ring by a threaded insert 23. Various other sighting devices may be substituted for disc 22 for example devices like filters or other optical devices may be installed either in combination or in interchange for this disc, the installation features being fully adapted to accommodate any combination. The disc 22 will preferably be colored yellow for clarity of the target in a fading light such as in late afternoon. When shooting is being done in early morning, the sight disc will be clear and transparent. If shooting is being done in full sunlight it is desired that the sight disc 22 be made from a "Polaroid" sheet material. In lieu of the sight disc 22 being colored, filters or light modifying devices of the type above-described may be removably mounted in the ring and held in abutting contact with the sight disc 22 by the insert 23.

Figure 3:
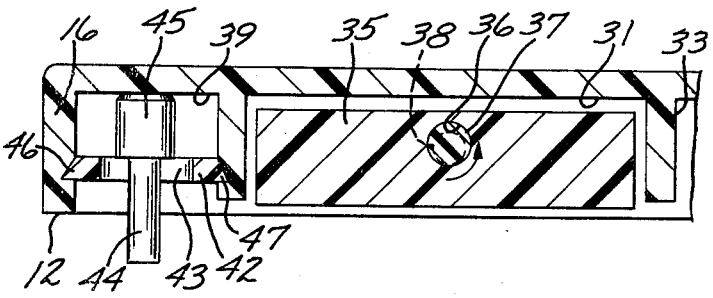
FIG. 3 is a detail side view in section illustrating the articulation implemented in the inventive sighting device disclosed herein.
Figure 2:
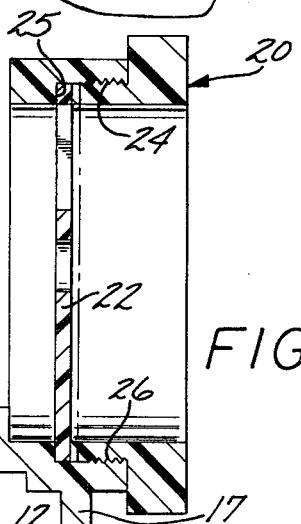
FIG. 2 is a side view, in section taken along line 2—2 of FIG. 1.
Figure 4:
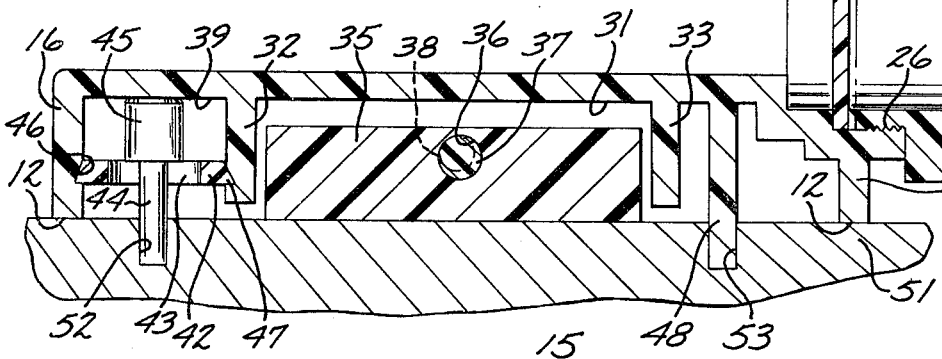
FIG. 4 is a bottom view of the sighting device constructed according to the present invention.
Figure 4:
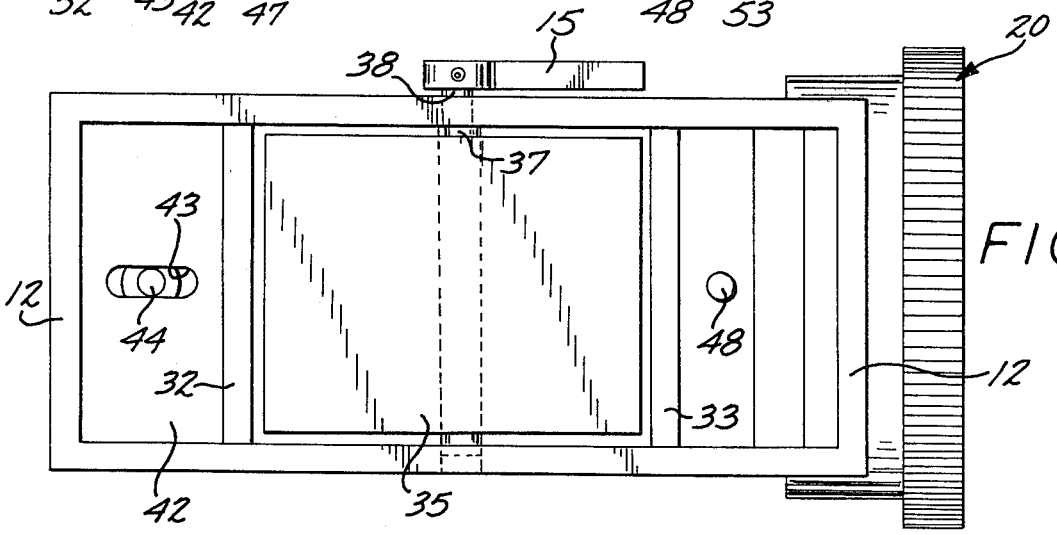

As shown in more detail in FIGS. 2, 3 and 4 fixture 11 includes a first or central cavity 31 bounded on the lateral sides by the lateral surfaces of the fixture and in the fore and aft direction by a front and rear separating wall 32 and 33 respectively. Walls 32 and 33 are recessed at the exterior edges thereof below the edges of the fixture 11, the separation in the fore and aft direction therebetween being somewhat greater than the longitudinal dimension of a rectangular ceramic magnet 35. Magnet 35, in turn, includes a transverse bore 36 extending laterally thereacross conformed to receive an eccentric cam or eccentrically displaced rod 37 extending from a pivot 38 connected to the lever 15. It is thus by virtue of the rotation of pivot 38 that an upward and downward manipulation of the magnet 35 can be achieved. As stated previously the exterior dimensions of fixture 11 are conformed along a surface 12 convolved for mating fit with the exterior of barrel 51. To this end, fixture 11 is shown to include a front and rear end plate 16 and 17 respectively end plate 16 together with the separating wall 32 forming a second or forward cavity 39, while end plate 17 and wall 33, in turn, define a rear or third cavity 41. Disposed within cavity 39 and extending longitudinally between the end wall 16 and the separating wall 32 is a horizontal slotted plate 42 including a longitudinal slot 43 aligned longitudinally with the fixture 11, slot 43 retaining a pin 44 including an enlarged cap 45 disposed between plate 42 and the upper surface of fixture 11. In order to provide convenience in assembly of the pin 44 on the interior of the fixture, both the end plate 16 and the separating wall 32 each include an opposing dovetail cutout respectively shown as cutouts 46 and 47, the ends of plate 42 being similarly cut on a taper to be thus press fit into the corresponding cutouts with the pin in position.

By virtue of this arrangement of parts, the fore and aft motion of pin 44 is assured allowing for the compensation in the distance separating this pin from yet another pin 48 extending downwardly within cavity 41 to similarly project beyond the surface 12. Pins 44 and 48 are conformed for receipt in the tapped opening in barrel 51, shown as openings 52 and 53 respectively, which have been previously utilized to support the conventional open rear sight of the firearm. Thus by virtue of this arrangement fixture 11 may be placed in position over the openings previously utilized to support the conventional open sight with a subsequent articulation of the lever 15, dropping by the eccentric motion of cam 37 the ceramic magnet 35 to contact the barrel 51. In this position, maximum flux levels are achieved between the magnet and the barrel providing the maximum retaining forces. Should removal be desired the actuation of lever 15 provides the necessary eccentric motion to separate the magent from its prior contiguous contact, reducing the flux level and therefore reducing the restraining forces to permit removal.

In order to provide for freedom of motion for the magnet 35 as set out, it is intended to utilize materials like plastics or nylon for the structure of fixture 11 and the sliding aperture 20. The convenience of plastic is well recognized in the art allowing great freedom in manufacture and an attendant low cost.

This same manufacturing process may provide for the concurrent forming of the sight ring 21 which may then be subsequently machined to provide an interiorly threaded segment 24 and a shoulder 25 for supporting the sight disc. The retainer 23 may be made as a casting including an exteriorly threaded segment 26 conformed to mate with the threads in segment 24. Thus the single machining process forming the shoulder 25 achieves all the necessary corrections in alignment necessary for the desired accuracy.

Should better tolerances be found achievable in the course of the forming of the sight even these machining steps may be avoided. The alignment of sight aperture 20 in close proximity with pin 48 reduces the requirement of high longitudinal tolerances, thus adopting the best advantages, of geometry to reduce production cost.

Obviously many modifications and variations to the above disclosure can be made without departing from the spirit of the invention. It is therefore intended that the scope of the invention be determined solely dependent on the claims hereto.

I claim:

1. A sighting device adapted for convenient substitution for a rear sight assembly attached by way of a fore and aft tapped opening in the barrel structure of a fire arm, comprising:

a rectangularly shaped support fixture which includes a central cavity on the interior thereof communicating to the exterior across a first lateral surface of said fixture, and a fore and aft cavity respectively formed in said fixture in longitudinal relationship adjacent said central cavity;

a ceramic magnet conformed for sliding receipt in said central cavity, including a transverse bore formed thereacross;

a lever assembly mounted for pivotal motion across said central cavity and including an eccentrically disposed center segment conformed for receipt in said transverse bore;

a support plate including a longitudinal slot receipted in said fore cavity in substantially parallel alignment with said first lateral surface, said longitudinal slot being disposed in longitudinal alignment relative said fixture;

a forward pin received for translation within said longitudinal slot and extending for insertion in said fore tapped opening;

an aft pin attached within said rear cavity and extending for receipt within said aft tapped opening; and a sighting aperture assembly formed on said fixture in adjacent proximity relative said aft pin.

2. Apparatus according to claim 1 wherein:

said sighting aperture assembly comprises a sighting ring extending normally above said fixture in substantially opposing relationship to said aft pin, a sighting disc receivable within said sighting ring, and a threadably engaged retainer received in said sighting ring for compressing said disc therebetween.

3. Apparatus according to claim 2 wherein:

said first lateral surface of said fixture is conformed to mate with the subjacent exterior surface of said fire arm.

4. Apparatus according to claim 3 wherein:

said ceramic magnet is dimensioned for vertical articulation within said central cavity according to the eccentric motion of said center segment, the exterior surface of said magnet being formed to align with said first lateral surface when said lever assembly is in a first state and being withdrawn into the interior of said central cavity when said lever assembly is in a second state.

5. Apparatus according to claim 4 wherein:

said lever assembly includes a manually articulated lever on the exterior of said fixture disposed for articulation between said first and second states.

6. Apparatus according to claim 5 wherein:

said fixture lever assembly, and sighting aperture all comprise nonmagnetic structure.

* * * * *